US009994017B2

(12) United States Patent
North et al.

(10) Patent No.: US 9,994,017 B2
(45) **Date of Patent: *Jun. 12, 2018**

(54) INKJET NOZZLE DEVICE HAVING IMPROVED LIFETIME

(71) Applicant: MEMJET TECHNOLOGY LTD., Dublin (IE)

(72) Inventors: Angus John North, North Ryde (AU); Christopher Saul Barton, North Ryde (AU)

(73) Assignee: Memjet Technology Limited (IE)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/404,127

(22) Filed: Jan. 11, 2017

(65) Prior Publication Data

US 2017/0120591 A1 May 4, 2017

Related U.S. Application Data

(63) Continuation of application No. 14/938,541, filed on Nov. 11, 2015, now Pat. No. 9,573,368.

(60) Provisional application No. 62/081,712, filed on Nov. 19, 2014.

(51) Int. Cl.
*B41J 2/14* (2006.01)
*B41J 2/16* (2006.01)

(52) U.S. Cl.
CPC ..... *B41J 2/14129* (2013.01); *B41J 2/14016* (2013.01); *B41J 2/1433* (2013.01); *B41J 2/14088* (2013.01); *B41J 2/14112* (2013.01); *B41J 2/1642* (2013.01)

(58) Field of Classification Search
CPC .. B41J 2/1408; B41J 2/14088; B41J 2/14016; B41J 2/14112; B41J 2/14129
See application file for complete search history.

(56) References Cited

U.S. PATENT DOCUMENTS 7,980,674 B2 * 7/2011 Silverbrook ..... B41J 2/04563 347/58
8,567,909 B2 * 10/2013 Sieber ..... B41J 2/03 347/45
2005/0233159 A1 * 10/2005 Fartash ..... B41J 2/14129 428/457
2016/0136957 A1 * 5/2016 North ..... B41J 2/1603 347/62

* cited by examiner

*Primary Examiner* — Geoffrey Mruk
(74) *Attorney, Agent, or Firm* — Cooley LLP

(57) ABSTRACT

An inkjet nozzle device includes a MEMS structure in contact with ink, wherein a tantalum oxide layer is deposited on at least part of the MEMS structure for inhibiting corrosion by the ink.

7 Claims, 5 Drawing Sheets

INKJET NOZZLE DEVICE HAVING IMPROVED LIFETIME

CROSS-REFERENCE TO RELATED APPLICATIONS

This application is a continuation of U.S. application Ser. No. 14/938,541, filed Nov. 11, 2015, entitled INKJET NOZZLE DEVICE HAVING IMPROVED LIFETIME, which claims the benefit of priority under 35 U.S.C. § 119(e) of U.S. Provisional Application No. 62/081,712, filed Nov. 19, 2014, entitled INKJET NOZZLE DEVICE HAVING IMPROVED LIFETIME, the contents of each of which is hereby incorporated by reference herein in its entirety for all purposes.

FIELD OF THE INVENTION

This invention relates to inkjet nozzle devices for inkjet printheads. It has been developed primarily to improve printhead lifetimes.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

In order to minimize the amount of silicon, and therefore the cost of pagewidth printheads, the nozzle packing density in each silicon printhead IC needs to be high. A typical Memjet® printhead IC contains 6,400 nozzle devices, which translates to 70,400 nozzle devices in an A4 printhead containing 11 Memjet® printhead ICs.

This high density of nozzle devices poses a thermal management problem: the ejection energy per drop ejected must be low enough to operate in so-called 'self-cooling' mode—that is, the chip temperature equilibrates to a steady state temperature well below the boiling point of the ink via removal of heat by ejected ink droplets.

Conventional inkjet nozzle devices comprise resistive heater elements coated with a number of relatively thick protective layers. These protective layers are necessary to protect the heater element from the harsh environment inside inkjet nozzle chambers. Typically, heater elements are coated with a passivation layer (e.g. silicon dioxide) to protect the heater element from corrosion and a cavitation layer (e.g. tantalum) to protect the heater element from mechanical cavitation forces experienced when a bubble collapses onto the heater element. U.S. Pat. No. 6,739,619 describes a conventional inkjet nozzle device having passivation and cavitation layers.

However, multiple passivation and cavitation layers are incompatible with low-energy 'self-cooling' inkjet nozzle devices. The relatively thick protective layers absorb too much energy and require drive energies which are too high for efficient self-cooling operation.

To some extent, the requirement for a tantalum cavitation layer can be mitigated by ensuring the device vents bubbles through the nozzle aperture instead of the bubbles collapsing onto the heater element. Moreover, durable corrosion-resistant materials, such as titanium aluminium nitride (TiAlN), may be employed as heater materials. As described in U.S. Pat. No. 7,147,306, the contents of which are incorporated herein by reference, a naked TiAlN heater element may be employed in direct contact with ink, providing excellent thermal efficiency and no loss of energy into protective layers. TiAlN heater materials have the ability to form a self-passivating, native aluminium oxide coating. The oxide formation is self-limiting in the sense that it prevents further oxide formation and minimizes heater resistance rise. However, the protective oxide is susceptible to attack by other corrosive species present in inks e.g. hydroxyl ions, dyes etc.

Atomic layer deposition (ALD) is an attractive method for depositing relatively thin protective layers onto heater elements in inkjet nozzle devices in order to improve printhead lifetimes. Thin protective layers (e.g. less than 50 nm thick) have minimal effect on thermal efficiency, enabling low ejection energies and facilitating self-cooling operation.

US2004/0070649 describes deposition of a dielectric passivation layer and a metal cavitation layer onto a resistive heater element using an ALD process.

U.S. Pat. No. 8,025,367 describes an inkjet nozzle device comprising a titanium aluminide heater element having passivating oxide. The heater element is optionally coated with a protective layer of silicon oxide, silicon nitride or silicon carbide by conventional CVD.

U.S. Pat. No. 8,567,909 describes deposition of a laminated stack comprising alternating layers of hafnium oxide and tantalum oxide onto a TiN heater element (as described in U.S. Pat. No. 6,739,519) using an ALD process. According to the authors of U.S. Pat. No. 8,567,909, the laminated stack minimizes the effects of so-called pinhole defects through the thin protective layers. Pinhole defects in ALD layers potentially enable penetration of corrosive ions through to the heater element. By employing a stack of alternating materials, alignment of pinhole defects between layers is minimized and, therefore, this type of laminated structure minimizes corrosion. However, a drawback of employing a laminated stack of ALD layers is increased fabrication complexity.

It would be desirable to provide inkjet nozzle devices having improved lifetimes. It would be particularly desirable to provide a self-cooling inkjet nozzle device, which ejects at least one billion droplets over a lifetime of the device and has minimal fabrication complexity.

SUMMARY OF THE INVENTION

In a first aspect, there is provided an inkjet nozzle device including a resistive heater element for ejecting ink droplets through a nozzle opening, the resistive heater element comprising:

an aluminide layer having a native passivating oxide; and a tantalum oxide layer disposed on the native passivating oxide of the aluminide layer.

Aluminides combine the advantageous characteristics of: a resistivity suitable for forming resistive heater elements in inkjet nozzle devices, formation of a self-passivating native oxide surface coating in situ, and suitability for deposition by sputtering in conventional MEMS fabrication processes.

As noted above, the formation of a passivating ('native') surface oxide is particularly advantageous for protecting aluminide heater materials against oxidation due to the low oxygen diffusivity of the surface oxide layer. However, the native aluminium oxide layer is susceptible to other corrosion mechanisms in aggressive aqueous ink environments. The present invention employs a very thin coating layer disposed (deposited) on the aluminide heater material, which seals the passivating aluminium oxide layer and minimizes its exposure to corrosive species present in inks. It has been found that the choice of material for the thin coating layer is critical for heater lifetime. For example, with titanium oxide and aluminium oxide coatings, it was found that heater lifetimes were comparable or worse than devices having no coating layer. However, surprisingly, a single coating layer of tantalum oxide deposited by ALD has been shown to be particularly effective in protecting an aluminide resistive heater element against oxidation and corrosion. The surprising robustness of a native aluminium oxide layer in combination with a thin tantalum oxide coating layer deposited thereon was hitherto not described in the prior art. It is particularly surprising that this combination was vastly superior to comparable coatings comprising deposited aluminium oxide and deposited tantalum oxide.

Without wishing to be bound by theory, it is understood by the present inventors that, when used in combination with a self-passivating aluminide, the coating layer effectively provides a multi-layered laminate coating, similar to those described in U.S. Pat. No. 8,567,909. The first coating layer is the self-passivating aluminium oxide layer having low oxygen diffusivity and the second coating layer (e.g. tantalum oxide) deposited by ALD has excellent resistance to corrosion in aqueous ink environments and excellent overall robustness. Thus, the present invention provides the advantages of laminated ALD coating layers, as described in U.S. Pat. No. 8,567,909, without requiring the complexity of a multi-layered deposition process. Moreover, there was observed a unique compatibility between the native oxide layer of aluminides and ALD-deposited tantalum oxide, which is not evident for other ALD coatings, even laminated ALD coatings comprising multiple layers of hafnium oxide and tantalum oxide.

Preferably, the aluminide layer is an intermetallic compound comprising aluminium and one or more transition metals. The transition metal is not particularly limited and may be any relatively electropositive transition metal, such as titanium, vanadium, manganese, niobium, tungsten, tantalum, zirconium, hafnium etc. However, transition metals that are compatible with existing MEMS fabrication processes, such as titanium and tantalum, are generally preferred.

Preferably, the aluminide comprises titanium and aluminium in a ratio in the range of 60:40 to 40:60 and, more preferably, 50:50. When the aluminium and titanium are present in about equal quantities, the aluminide has a resistivity suitable for use as an inkjet heater element. Moreover, with about equal atomic ratios, sputtering conditions may be readily achieved which provide a dense microstructure. A dense microstructure advantageously minimizes diffusion paths and minimizes corrosion.

In one embodiment, the intermetallic compound is titanium aluminide.

In another embodiment, the intermetallic compound is of formula TiAlX, wherein X comprises one or more elements selected from the group consisting of Ag, Cr, Mo, Nb, Si, Ta and W. For example, the intermetallic compound may be TiAlNbW. The presence of other metals in relatively small quantities, in addition to titanium and aluminium, helps to improve oxidation resistance.

Typically, Ti contributes more than 40% by weight, Al contributes more than 40% by weight and X contributes less than 5% by weight. Usually, the relative amounts of Ti and Al are about the same.

Preferably, the aluminide heater element has a thickness in the range of about 0.1 to 0.5 microns.

Preferably, the tantalum oxide layer is deposited by atomic layer deposition (ALD). However, it will be appreciated that the present invention is not limited to any particular type of deposition process and the skilled person will be aware of other deposition processes e.g. reactive sputtering.

Preferably, the tantalum oxide layer is a mono-layer.

Preferably, the tantalum oxide coating layer has a thickness of less than 500 nm. Preferably, the tantalum oxide coating layer has a thickness in the range of 5 to 100 nm, or preferably 5 to 50 nm, or preferably, 10 to 50 nm or preferably 10 to 30 nm. With a relatively thin coating layer (e.g. less than 100 nm), the heater element can operate at low drive energies and achieve self-cooling operation with minimal compromise of thermal efficiency. Moreover, relatively thin coating layers (e.g. 5 to 50 nm) are readily achievable using an ALD process whilst still providing excellent anti-corrosion characteristics.

Preferably, the resistive heater element is absent any wear-prevention or cavitation layers. For example, the resistive heater element is preferably absent any relatively thick oxide or metal layers deposited on the tantalum oxide layer. In this context, "relatively thick" means an additional coating layer having a thickness of more than 20 nm. In some instances, a thin layer (e.g. less than 10 nm) of silicon oxide or aluminium oxide may be present on the tantalum oxide layer as an artifact of MEMS fabrication. However, such layers have negligible effect on cavitation and are not within the ambit of the term "wear-prevention or cavitation layers".

Preferably, the resistive heater element is absent any additional layers disposed on the tantalum oxide layer.

Preferably, the inkjet nozzle device comprises a nozzle chamber having a roof defining a nozzle aperture, a floor, and sidewalls extending between the roof and the floor.

Preferably, the resistive heater element is bonded to the floor of the nozzle chamber. However, the present invention not limited to bonded heater elements and may, in some embodiments, be used to apply a conformal coating to suspended heater elements, as described in, for example, U.S. Pat. No. 7,264,335, the contents of which are herein incorporated by reference.

Preferably, the nozzle chamber and the resistive heater element are configured to allow bubble venting through the nozzle aperture during droplet ejection. Suitable configurations for bubble venting are described in, for example, U.S. application Ser. No. 14/540,999 filed on 13 Nov. 2014, the contents of which are incorporated herein by reference. As described in U.S. application Ser. No. 14/540,999, the inkjet nozzle device preferably comprises:

a firing chamber for containing ink, the firing chamber having a floor and a roof defining an elongate nozzle aperture having a perimeter; and an elongate heater element bonded to the floor of the firing chamber, the heater element and nozzle aperture having aligned longitudinal axes, wherein the device is configured to satisfy the relationships A and B:

A=swept volume/area of heater element=8 to 14 microns

B=firing chamber volume/swept volume=2 to 6 wherein the swept volume is defined as the volume of a shape defined by a projection from the perimeter of the nozzle aperture to the floor of the firing chamber, the swept volume including a volume contained within the nozzle aperture.

Alternative configurations suitable for bubble venting are described in U.S. Pat. No. 6,113,221.

Preferably, the resistive heater element is absent any wear-prevention or cavitation layers. Configuring the inkjet nozzle device for bubble-venting obviates additional coating layers for protecting the heater element against cavitation forces that would otherwise result from bubble collapse. By avoiding additional coating layers through bubble-venting, the device is more thermally efficient and can operate in a self-cooling manner.

In a second aspect, there is provided an inkjet printhead comprising a plurality of inkjet nozzle devices as described above. The printhead may be, for example, a pagewidth inkjet printhead having a nozzle density sufficient to print dots at a native resolution of at least 800 dpi or at least 1200 dpi. The printhead may be comprised of a plurality of printhead ICs arranged across a pagewidth.

In a third aspect, there is provided a method of ejecting a droplet of ink from an inkjet nozzle device including a resistive heater element, the resistive heater element comprising an aluminide layer having a native passivating oxide and a tantalum oxide layer disposed on the native passivating oxide of the aluminide layer, the method comprising the steps of:

supplying ink to the inkjet nozzle device;

heating the resistive heater element to a temperature sufficient to form a bubble in the ink; and ejecting the droplet of ink from a nozzle aperture of the inkjet nozzle device.

Preferably, the bubble is vented through the nozzle aperture so as to avoid cavitation forces on the heater element resulting from bubble collapse.

Preferably, at least 1 billion droplets of ink are ejected before failure. In this context, "failure" is given to mean that, in a given sample of inkjet nozzle device, about 1.5% of those devices are not ejecting ink after 1 billion ejections.

Other aspects of the inkjet nozzle device, as described in connection with the first aspect, are of course equally applicable to the second and third aspects described herein.

As used herein, the term "aluminide" has it conventional meaning in the art—that is, an intermetallic compound comprising aluminium and at least one more electropositive element. Typically, the more electropositive element is a transition metal.

BRIEF DESCRIPTION OF THE DRAWINGS

Embodiments of the present invention will now be described by way of example only with reference to the accompanying drawings, in which.

DETAILED DESCRIPTION OF THE INVENTION

Inkjet Nozzle Device Having Bonded Heater Element

Figure 1:
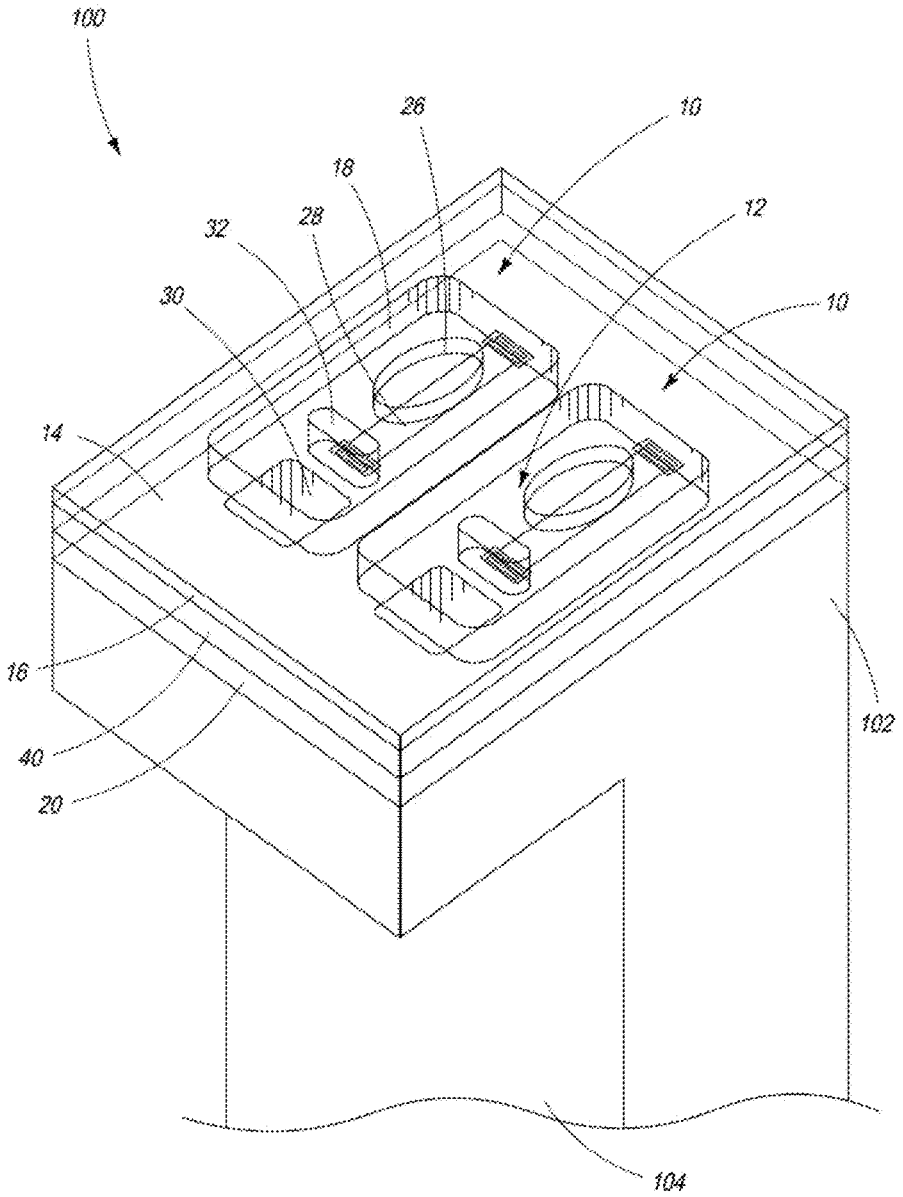
FIG. 1 is a cutaway perspective view of part of a printhead having a heater element bonded to a floor of a nozzle chamber.
Figure 2:
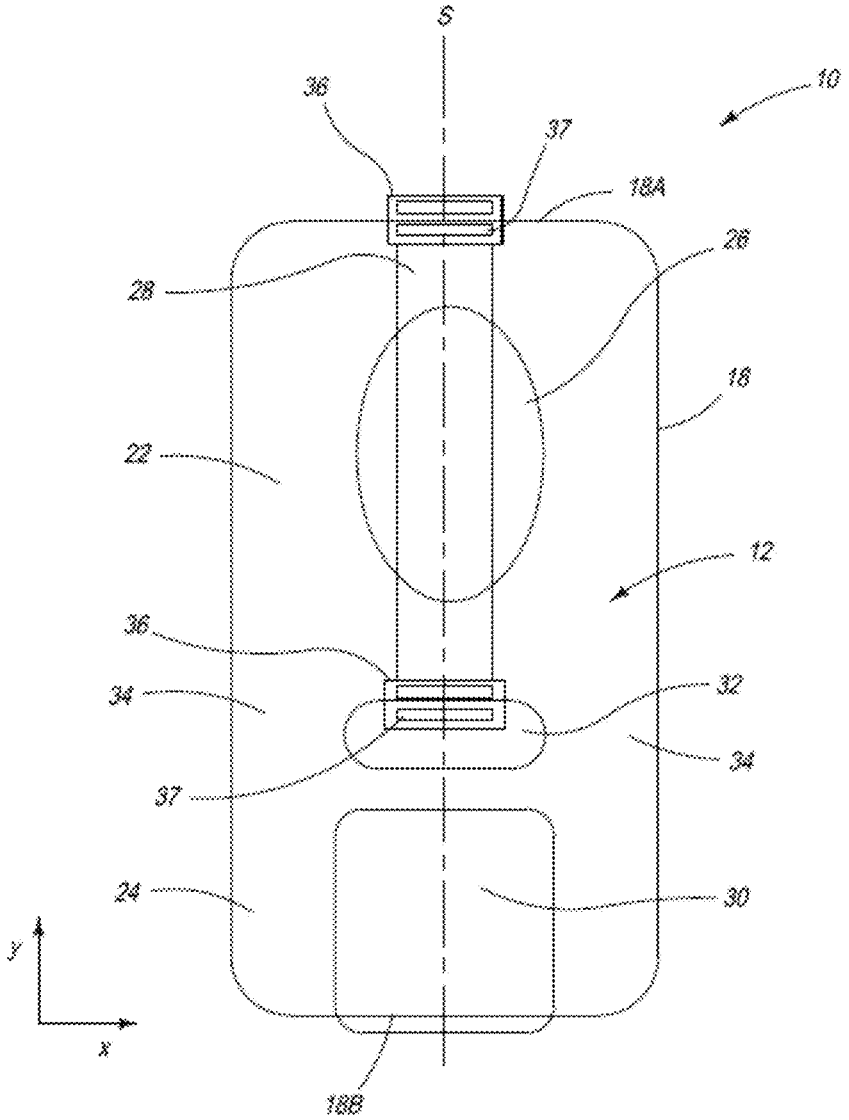
FIG. 2 is a plan view of one of the inkjet nozzle devices shown in FIG. 1.
Figure 3:
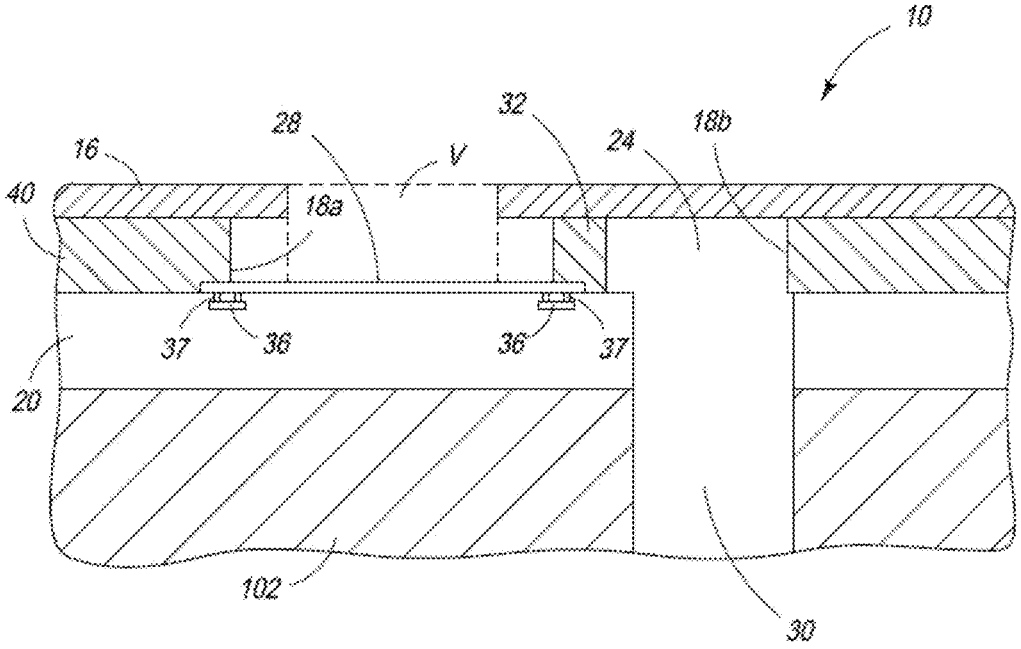
FIG. 3 is a sectional side view of one of the inkjet nozzle devices shown in FIG. 1.

Referring to FIGS. 1 to 3, there is shown an inkjet nozzle device 10 as described in U.S. application Ser. No. 14/310,353 filed on Jun. 20, 2014, the contents of which are incorporated herein by reference.

The inkjet nozzle device comprises a main chamber 12 having a floor 14, a roof 16 and a perimeter wall 18 extending between the floor and the roof. Typically, the floor is defined by a passivation layer covering a CMOS layer 20 containing drive circuitry for each actuator of the printhead. FIG. 1 shows the CMOS layer 20, which may comprise a plurality of metal layers interspersed with interlayer dielectric (ILD) layers.

In FIG. 1 the roof 16 is shown as a transparent layer so as to reveal details of each nozzle device 10. Typically, the roof 16 is comprised of a material, such as silicon dioxide or silicon nitride.

Referring now to FIG. 2, the main chamber 12 of the nozzle device 10 comprises a firing chamber 22 and an antechamber 24. The firing chamber 22 comprises a nozzle aperture 26 defined in the roof 16 and an actuator in the form of a resistive heater element 28 bonded to the floor 14. The antechamber 24 comprises a main chamber inlet 30 ("floor inlet 30") defined in the floor 14.

The main chamber inlet 30 meets and partially overlaps with an endwall 18B of the antechamber 24. This arrangement optimizes the capillarity of the antechamber 24, thereby encouraging priming and optimizing chamber refill rates.

A baffle wall or plate 32 partitions the main chamber 12 to define the firing chamber 22 and the antechamber 24. The baffle plate 32 extends between the floor 14 and the roof 16. As shown most clearly in FIG. 3, the side edges of the baffle plate 32 are typically rounded, so as to minimize the risk of roof cracking. (Sharp angular corners in the baffle plate 32 tend to concentrate stress in the roof 16 and floor 14, thereby increasing the risk of cracking).

The nozzle device 10 has a plane of symmetry extending along a nominal y-axis of the main chamber 12. The plane of symmetry is indicated by the broken line S in FIG. 2 and bisects the nozzle aperture 26, the heater element 28, the baffle plate 32 and the main chamber inlet 30.

The antechamber 24 fluidically communicates with the firing chamber 22 via a pair of firing chamber entrances 34 which flank the baffle plate 32 on either side thereof. Each firing chamber entrance 34 is defined by a gap extending between a respective side edge of the baffle plate 32 and the perimeter wall 18. Typically, the baffle plate 32 occupies about half the width of the main chamber 12 along the x-axis, although it will be appreciated that the width of the baffle plate may vary based on a balance between optimal refill rates and optimal symmetry in the firing chamber 22.

The nozzle aperture 26 is elongate and takes the form of an ellipse having a major axis aligned with the plane of symmetry S. The heater element 28 takes the form of an elongate bar having a central longitudinal axis aligned with the plane of symmetry S. Hence, the heater element 28 and elliptical nozzle aperture 26 are aligned with each other along their y-axes.

As shown in FIG. 2, the centroid of the nozzle aperture 26 is aligned with the centroid of the heater element 28. However, it will be appreciated that the centroid of the nozzle aperture 26 may be slightly offset from the centroid of the heater element 28 with respect to the longitudinal axis of the heater element (y-axis). Offsetting the nozzle aperture 26 from the heater element 28 along the y-axis may be used to compensate for the small degree of asymmetry about the x-axis of the firing chamber 22. Nevertheless, where offsetting is employed, the extent of offsetting will typically be relatively small (e.g. about 2 microns or less).

The heater element 28 extends between an end wall 18A of the firing chamber 22 (defined by one side of the perimeter wall 18) and the baffle plate 32. The heater element 28 may extend an entire distance between the end wall 18A and the baffle plate 32, or it may extend substantially the entire distance (e.g. 90 to 99% of the entire distance) as shown in FIG. 2. If the heater element 28 does not extend an entire distance between the end wall 18A and the baffle plate 32, then a centroid of the heater element 28 still coincides with a midpoint between the end wall 18A and the baffle plate 32 in order to maintain a high degree of symmetry about the x-axis of firing chamber 22. In other words a gap between the end wall 18A and one end of the heater element 28 is equal to a gap between the baffle plate 32 and the opposite end of the heater element.

The heater element 28 is connected at each end thereof to respective electrodes 36 exposed through the floor 14 of the main chamber 12 by one or more vias 37. Typically, the electrodes 36 are defined by an upper metal layer of the CMOS layer 20. The vias 27 may be filled with any suitable conductive material (e.g. copper, aluminium, tungsten etc.) to provide electrical connection between the heater element 28 and the electrodes 36. A suitable process for forming electrode connections from the heater element 28 to the electrodes 36 is described in U.S. Pat. No. 8,453,329, the contents of which are incorporated herein by reference.

In some embodiments, at least part of each electrode 36 is positioned directly beneath an end wall 18A and baffle plate 32 respectively. This arrangement advantageously improves the overall symmetry of the device 10, as well as minimizing the risk of the heater element 28 delaminating from the floor 14.

As shown most clearly in FIG. 1, the main chamber 12 is defined in a blanket layer of material 40 deposited onto the floor 14 by a suitable etching process (e.g. plasma etching, wet etching, photo etching etc.). The baffle plate 32 and the perimeter wall 18 are defined simultaneously by this etching process, which simplifies the overall MEMS fabrication process. Hence, the baffle plate 32 and perimeter wall 18 are comprised of the same material, which may be any suitable etchable ceramic or polymer material suitable for use in printheads. Typically, the material is silicon dioxide or silicon nitride.

Referring back to FIG. 2, it can be seen that the main chamber 12 is generally rectangular having two longer sides and two shorter sides. The two shorter sides define end walls 18A and 18B of the firing chamber 22 and the antechamber 24, respectively, while the two longer sides define contiguous sidewalls of the firing chamber and antechamber. Typically, the firing chamber 22 has a larger volume than the antechamber 24.

A printhead 100 may be comprised of a plurality of inkjet nozzle devices 10. The partial cutaway view of the printhead 100 in FIG. 1 shows only two inkjet nozzle devices 10 for clarity. The printhead 100 is defined by a silicon substrate 102 having the passivated CMOS layer 20 and a MEMS layer containing the inkjet nozzle devices 10. As shown in FIG. 1, each main chamber inlet 30 meets with an ink supply channel 104 defined in a backside of the printhead 100. The ink supply channel 104 is generally much wider than the main chamber inlets 30 and effectively a bulk supply of ink for hydrating each main chamber 12 in fluid communication therewith. Each ink supply channel 104 extends parallel with one or more rows of nozzle devices 10 disposed at a frontside of the printhead 100. Typically, each ink supply channel 104 supplies ink to a pair of nozzle rows (only one row shown in FIG. 1 for clarity), in accordance with the arrangement shown in FIG. 21B of U.S. Pat. No. 7,441,865.

The inkjet nozzle device 10 has been described above purely for the sake of completeness. Nevertheless, it will be appreciated that the present invention is applicable to any type of inkjet nozzle device comprising a resistive heater element. The skilled person will be readily aware of many such devices, as described in the prior art.

Aluminide Heater Element Having Coating Layer

Figure 4:
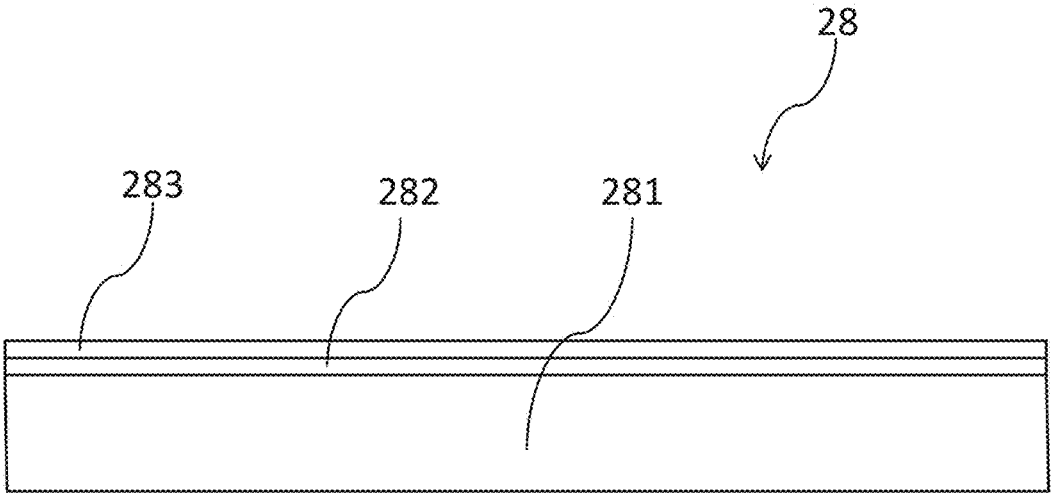
FIG. 4 is a schematic side view of a coated resistive heater element.

Referring now to FIG. 4, there is shown a side view of a heater element 28, which includes a tantalum oxide coating layer 283 deposited by ALD. The heater element 28 may be employed in the inkjet nozzle device 10, as described above, or any other suitable thermal inkjet device known in the art.

The heater element 28 comprises a 0.3 micron titanium aluminide layer 281 formed by conventional sputtering, a native aluminium oxide layer 282 on a surface of the titanium aluminide layer 281, and a 20 nm tantalum oxide coating layer 283 covering the native aluminium oxide layer 282. Notably, the native aluminium oxide layer 282 and the tantalum oxide coating layer 283 are very thin layers, which have minimal impact on the thermal efficiency of the heater element 28.

The coating layer 283 may be deposited by any suitable ALD process. Suitable ALD processes will be readily to apparent those skilled in the art and are described in, for example, Liu et al, *J. Electrochemical Soc.,* 152(3), G213-G219, (2005); and Matero et al, *J. Phys. IV France,* 09 (1999), PR8, 493-499.

The coating layer 283 may be deposited at any suitable stage of MEMS fabrication. For example, the coating layer 283 is preferably deposited immediately after deposition of the aluminide layer 281 as part of a front-end MEMS process flow during printhead integrated circuit (IC) fabrication. Alternatively, the ALD process may be employed as a retrofit process for existing printhead ICs in order to improve printhead lifetimes.

Experimental Section

Fabricated printhead ICs having bonded heater elements were cleaned in DMSO solvent, washed with ethanol then deionized water, and dried using filtered compressed air. The bonded heater element of each printhead IC was comprised of a 300 nm layer of titanium aluminide (50% titanium; 50% aluminium). After cleaning, washing and drying, the printhead ICs were then placed in a standard ALD chamber and treated with an oxygen plasma for 10 minutes. Following oxygen treatment, at least one coating layer was deposited by a high-temperature (400° C.) ALD process. Using Auger Electron Spectroscopy (AES), a native aluminium oxide layer of the titanium aluminide, which is subjacent the ALD-deposited coating layer, was estimated to have a thickness of about 20 nm.

Following ALD treatment, an individual printhead IC was mounted in a modified printing rig and primed with a standard black dye-based ink using a suitably modified ink delivery system. A start-of-life test of print quality as a function of drive energy was conducted to set actuation pulse widths at a value which replicates operation in an otherwise unmodified printer. The drive energies and device geometries of each printhead IC are configured for venting bubbles through nozzle apertures during droplet ejection.

In this configuration the printhead IC was subjected to repeat cycles of: i) a resistance measurement for all heaters, ii) a print quality test, and iii) a number of bulk actuations over a spittoon with a consistent and uniform print pattern simulating the ageing of a device in a real print system. The device was maintained with an automatic wiping system mimicking the maintenance routine in an unmodified printer. Maintenance was conducted prior to both the print quality test and spittoon aging; additional maintenance was conducted regularly during the spittoon printing at the equivalent of every 50 pages of normal printing.

An individual heater was deemed to be open-circuit ("bad") when it reached a resistance of 100 Ohms; any heater with a resistance of <100 Ohms was deemed to be a "good" heater. It was further observed that the print quality over life was acceptable whilst the majority of the heaters tested were good, and that print quality became unacceptable at an inflection point where a small but significant number of heaters started to fail.

Figure 5:
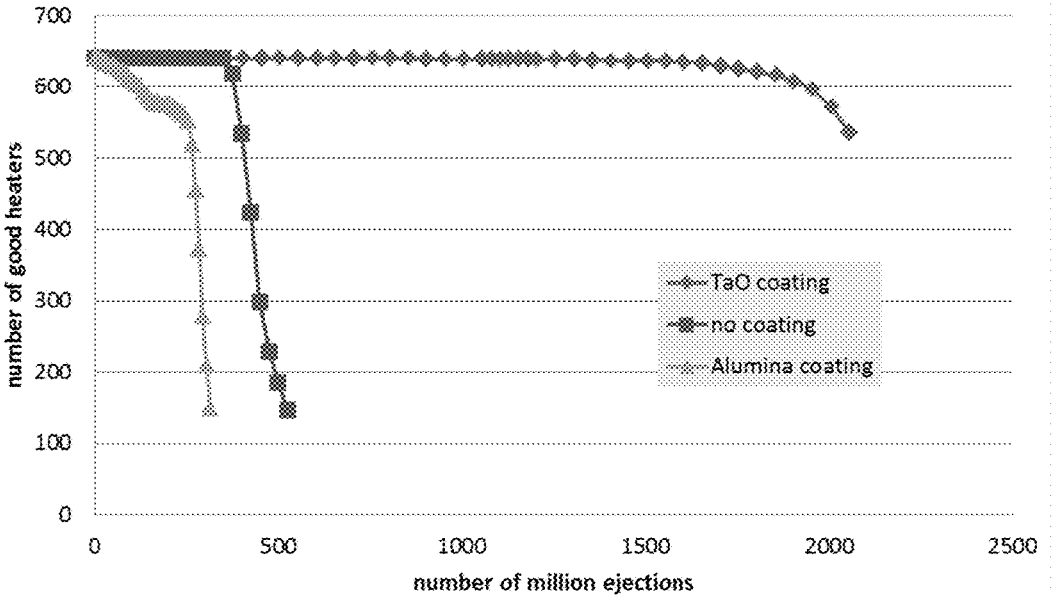
FIG. 5 shows lifetimes of various heater elements.

FIG. 5 shows the results of initial testing on heater elements having no ALD coating, a 20 nm ALD aluminium oxide coating, and a 20 nm ALD tantalum oxide coating. From FIG. 5, it can be seen that the heater elements with no ALD coating failed at about 400 million ejections. Surprisingly, the heater elements having a 20 nm ALD aluminium oxide coating failed more quickly (at about 200 million ejections) than the uncoated heater elements. However, the heater elements having a 20 nm ALD tantalum oxide coating continued to operate with minimal failures and good print quality up to about 1700 million ejections—the highest number of ejections observed for this type of printhead IC.

Table 1 summarizes the results of various other ALD coatings tested with a dye-based ink, in accordance with the printhead lifetime experimental protocol described above.

TABLE 1

Printhead Lifetime Testing With Various ALD Coatings

| | ALD Coating(s)[a] | Number of ejections before failure |
|---|---|---|
| Example 1 | 20 nm $Ta_2O_5$ | 1700 million |
| Comparative Example 1 | none | 400 million |
| Comparative Example 2 | 20 nm $Al_2O_3$ | 200 million |
| Comparative Example 3 | 20 nm $TiO_2$ | <5 million |
| Comparative Example 4 | 20 nm $TiO_2$ + 20 nm $Al_2O_3$ | 150 million |
| Comparative Example 4 | (2 nm $TiO_2$ + 2 nm $Al_2O_3$) × 10 | 150 million |
| Comparative Example 5 | 20 nm $Al_2O_3$ + 20 nm $HfO_2$ | 400 million |
| Comparative Example 6 | 20 nm $Al_2O_3$ + 20 nm $Ta_3N_5$ | 250 million |
| Comparative Example 7 | 20 nm $Al_2O_3$ + 20 nm $Ta_2O_5$ | 250 million |

[a]For multilayered coatings, the layer deposited first is mentioned first in Table 1.

It was concluded that the 20 nm tantalum oxide coating and the native oxide of the titanium aluminide behave synergistically to provide a particularly effective laminate coating of the heater element. This synergy was not observed for other ALD coating layers tested, such as titanium oxide, aluminium oxide and combinations thereof. Moreover, even if a 20 nm ALD aluminium oxide layer is deposited between the tantalum oxide layer and the native oxide layer, then relatively poor lifetimes result (see Comparative Examples 5 and 7).

Without wishing to be bound by theory, it is understood by the present inventors that the native aluminium oxide layer provides low oxygen diffusivity which minimizes oxidation of the titanium aluminide via ingress of adventitious dissolved oxygen in the ink. Furthermore, the tantalum oxide layer protects the native oxide layer from the corrosive aqueous ink environment, as well as providing mechanical robustness. In contrast with the native oxide layer, it appears that an ALD aluminium oxide layer disrupts the effectiveness of a superjacent tantalum oxide layer, rendering this combination less effective. This may be due to a microstructural incompatibility between ALD aluminium oxide and tantalum oxide layers, which is not evident for the native oxide.

From the initial testing, it was clear that the ALD tantalum oxide coating, when deposited directly onto the native oxide layer of titanium aluminide, produced an outstanding heater lifetime result. It was anticipated that similar transition metal oxides (e.g. hafnium oxide) deposited by ALD directly onto the native oxide layer would produce similar results to tantalum oxide. Table 2 shows the results of various hafnium oxide and tantalum oxide coatings with both aqueous dye-based and pigment-based inks.

TABLE 2

Printhead Lifetime Testing With $Ta_2O_5$ and $HfO_2$ ALD Coatings

| | ALD Coating(s)[b] | Ink type | Number of ejections before failure |
|---|---|---|---|
| Example 1 | 20 nm $Ta_2O_5$ | dye | 1700 million |
| Comparative Example 1 | none | dye | 400 million |
| Comparative Example 8 | 20 nm $HfO_2$ | dye | 305 million |
| Comparative Example 9[a] | 40 nm multilayer: [(6 nm $HfO_2$ + 1 nm $Ta_2O_5$) × 4] + 6 nm $HfO_2$ + 6 nm $Ta_2O_5$ | dye | 230 million |
| Example 2 | 20 nm $Ta_2O_5$ + 6 nm $Al_2O_3$ | dye | 900 million |
| Example 3 | 20 nm $Ta_2O_5$ | pigment | 1265 million |
| Example 4 | 40 nm $Ta_2O_5$ | dye | 1105 million |
| Example 5 | 40 nm $Ta_2O_5$ | pigment | 1200 million |

[b]For multilayered coatings, the layer deposited first is mentioned first in Table 2.

Surprisingly, when hafnium oxide was deposited onto the native oxide layer, heater lifetimes were still worse than having no ALD coating layer at all (Comparative Examples 1 and 8). Even more surprising was that, with an alternating stack of hafnium oxide and tantalum oxide, heater lifetimes were still significantly worse than having no ALD coating layer at all (Comparative Examples 1 and 9). These results suggest that the efficacy of ALD coatings may not be due to the composition of the coating(s) per se, but is in fact more strongly linked to the interface between the ALD coating layer and its subjacent layer. In particular, it was observed that there is a unique synergy between a tantalum oxide ALD layer and a subjacent native oxide layer of titanium aluminide. Conversely, it appears that other ALD layers (e.g. titanium oxide, aluminium oxide, hafnium oxide) decrease heater lifetimes relative to the uncoated heater element, possibly via disruption of the protective native oxide layer of the aluminide.

In summary, the present invention provides excellent heater lifetimes using an ALD tantalum oxide layer deposited directly onto the native oxide of aluminide heater elements. The use of a single ALD coating layer is advantageous, because it potentially reduces MEMS fabrication complexity and does not impact on self-cooling operation of inkjet nozzle devices.

Additional wear-prevention and/or cavitation layer(s), such as tantalum metal, on the ALD tantalum oxide layer may be avoided by configuring the inkjet nozzle devices for bubble-venting during droplet ejection. Suitable chamber configurations for bubble venting through the nozzle aperture during droplet ejection are described in U.S. application Ser. No. 14/540,999, the contents of which are incorporated herein by reference. In this way, the number and thickness of coating layers is minimized, which improves thermal efficiency, lowers drop ejection energies and enables self-cooling operation for pagewidth printing.

It will, of course, be appreciated that the present invention has been described by way of example only and that modifications of detail may be made within the scope of the invention, which is defined in the accompanying claims.

The invention claimed is:

1. An inkjet nozzle device comprising:

an aluminide heater element having native passivating oxide;

a discrete tantalum oxide layer is deposited directly on the aluminide heater element; and a discrete metal oxide layer deposited directly on the tantalum oxide layer, wherein the aluminide heater element lacks any additional tantalum metal or tantalum oxide layers.

2. The inkjet nozzle device of claim 1, wherein the tantalum oxide layer is deposited by atomic layer deposition.

3. The inkjet nozzle device of claim 1, wherein the tantalum oxide layer has a thickness in the range of 10 to 50 nm.

4. The inkjet nozzle device of claim 1, wherein the metal oxide layer is a layer of aluminium oxide.

5. The inkjet nozzle device of claim 1, wherein the aluminide heater element is positioned in a nozzle chamber having a roof defining a nozzle aperture, a floor, and sidewalls extending between the roof and the floor.

6. The inkjet nozzle device of claim 5, wherein the aluminide heater element is bonded to the floor of the nozzle chamber.

7. The inkjet nozzle device of claim 6, wherein the aluminide heater element is comprised of an intermetallic compound of formula TiAlX, wherein X comprises one or more elements selected from the group consisting of Ag, Cr, Mo, Nb, Si, Ta and W.

* * * * *